United States Patent [19]

Suzuki et al.

[11] Patent Number: 4,770,358

[45] Date of Patent: Sep. 13, 1988

[54] AUTOMATIC CUTTING AND WINDING APPARATUS FOR A WEB-LIKE MATERIAL SUCH AS A FILM

[75] Inventors: Tsutomu Suzuki; Katsumi Nakamura; Kazuo Kishimoto, all of Nagoya, Japan

[73] Assignee: Mitsubishi Jukogyo Kabushiki Kaisha, Tokyo, Japan

[21] Appl. No.: 24,382

[22] Filed: Mar. 10, 1987

[30] Foreign Application Priority Data

| | | | |
|---|---|---|---|
| Mar. 17, 1986 | [JP] | Japan | 61-58818 |
| Jun. 3, 1986 | [JP] | Japan | 61-127331 |
| Jun. 3, 1986 | [JP] | Japan | 61-127332 |
| Jun. 3, 1986 | [JP] | Japan | 61-127333 |
| Jul. 23, 1986 | [JP] | Japan | 61-171876 |
| Feb. 4, 1987 | [JP] | Japan | 62-22491 |

[51] Int. Cl.[4] ..... B65H 19/26; B65H 19/28

[52] U.S. Cl. ..... 242/56 A; 226/190

[58] Field of Search ..... 242/56 A, 56 R, 64; 226/190, 191

[56] References Cited

U.S. PATENT DOCUMENTS

| | | | |
|---|---|---|---|
| 2,256,082 | 9/1941 | Feurt . | |
| 2,942,796 | 6/1960 | Gurney et al. | 242/56 A |
| 3,323,739 | 6/1967 | Deming | 242/56 A |
| 3,501,104 | 3/1970 | Hellemans | 242/56 A |
| 3,697,010 | 10/1972 | Nystrand | 242/56 A |
| 4,058,267 | 11/1977 | Schuttler | 242/56 A |
| 4,326,679 | 4/1982 | Phelps et al. | 242/56 A |
| 4,458,852 | 7/1984 | Calvert et al. | 242/56 A |
| 4,678,133 | 7/1987 | Suzuki | 242/56 A |

FOREIGN PATENT DOCUMENTS

| | | |
|---|---|---|
| 3003403 | 8/1981 | Fed. Rep. of Germany . |
| 33825 | 8/1972 | Japan . |

*Primary Examiner*—Jillions: John M.

*Attorney, Agent, or Firm*—Wenderoth, Lind & Ponack

[57] ABSTRACT

In the known turret type automatic cutting and winding apparatus for automatically cutting a web-like material such as a film or the like, in order to eliminate scratches and/or uneven deformation which can be generated at a cut end portion of a web-like material during tapeless winding also to obviate creases which might occur in a mill roll, an electrostatic charging means is mounted on a swingable arm for giving electrostatic charge to a cut end portion of the web-like material and/or to a surface of a core, a cutter and a pair of press members are swingably mounted and oppose each other across the web-like material, and the arrangement is such that the press members may be positioned with the cutter when at a cutting position therebetween.

11 Claims, 11 Drawing Sheets

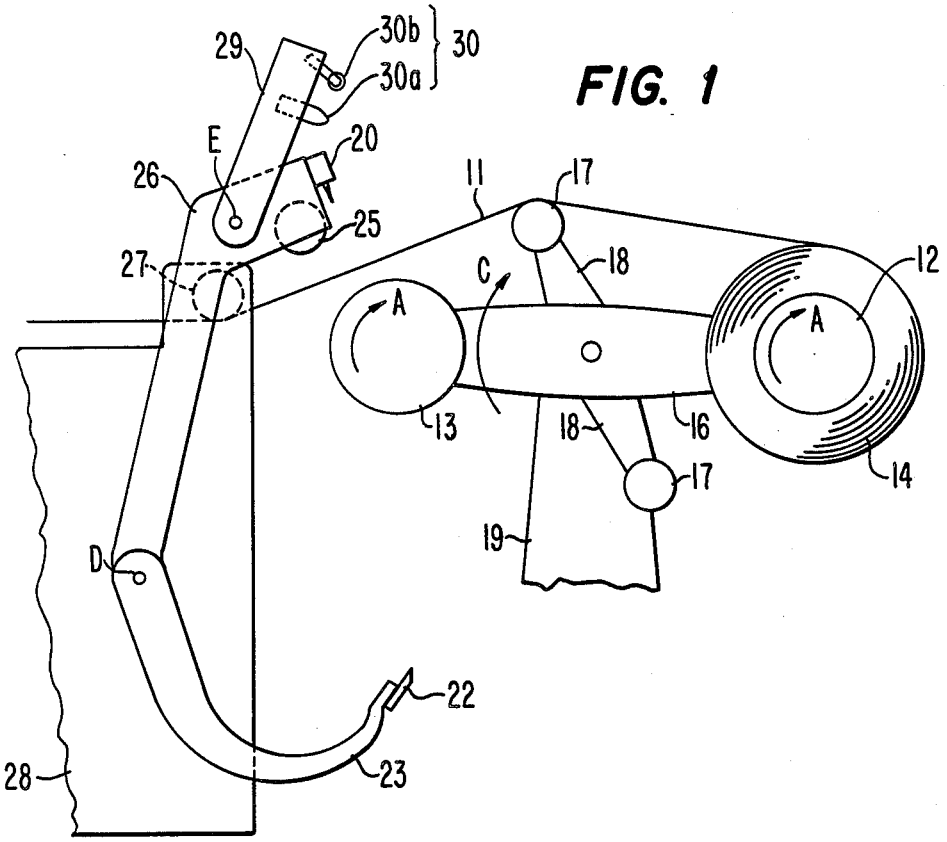
FIG. 1
FIG. 2
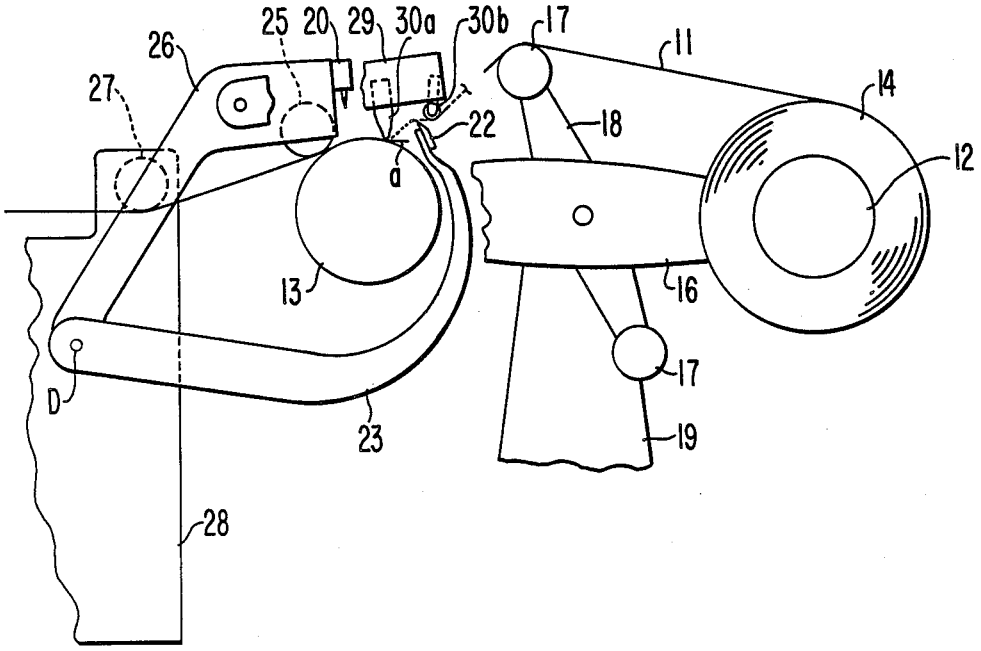

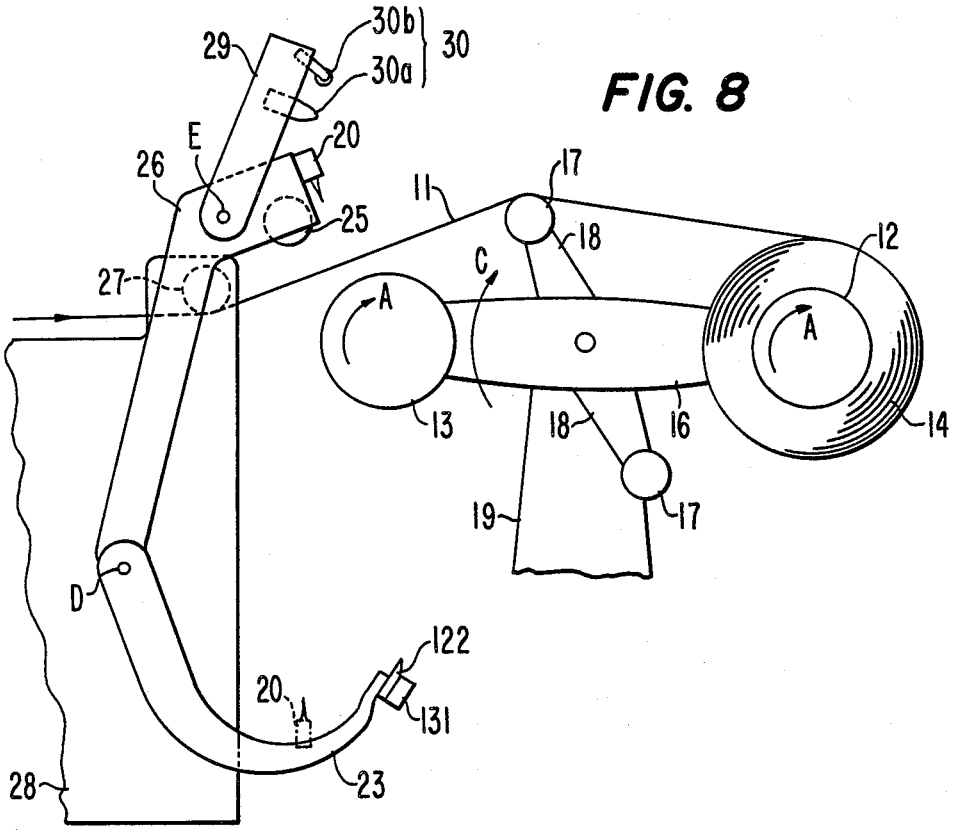
FIG. 8
FIG. 9
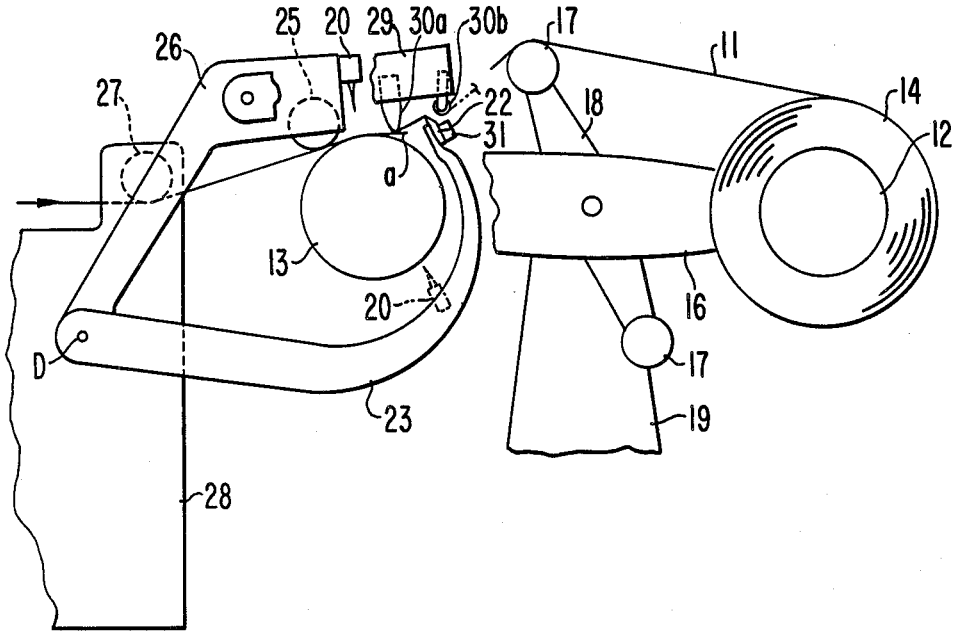

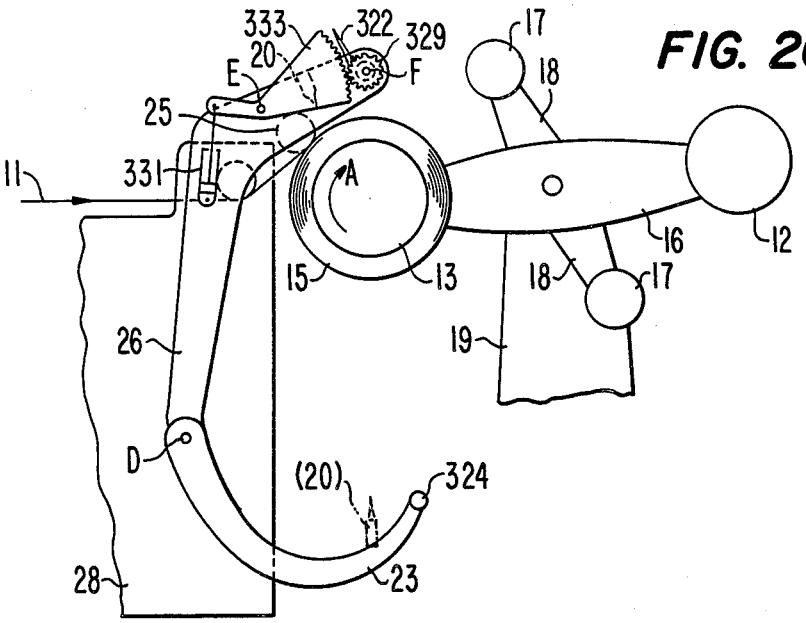
FIG. 20
FIG. 21
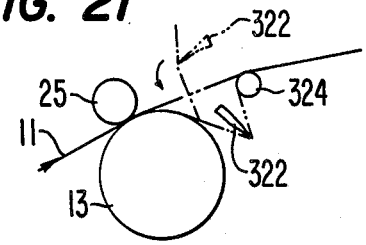
FIG. 22
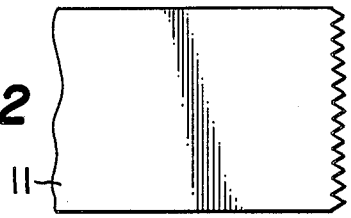
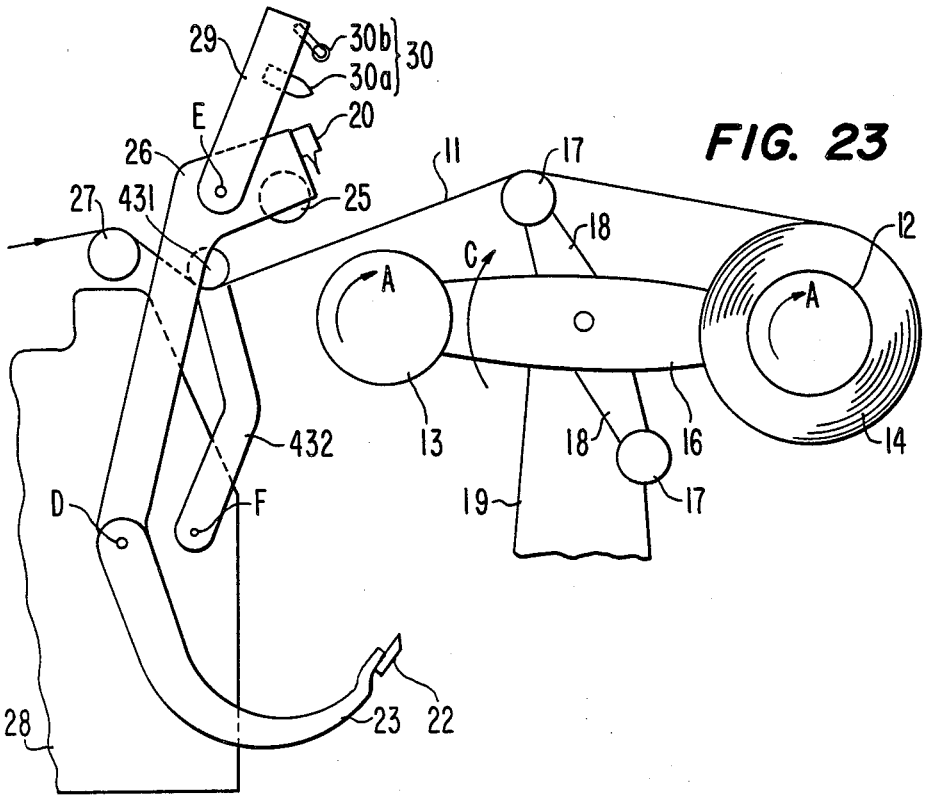
FIG. 23

AUTOMATIC CUTTING AND WINDING APPARATUS FOR A WEB-LIKE MATERIAL SUCH AS A FILM

BACKGROUND OF THE INVENTION

1. Field of the Invention

The present invention relates to an automatic cutting and winding apparatus for a web-like material such as a film, which automatically cuts a web-like material such as a film and continuously performs rewinding. The present invention can also be used for winding a web of paper, cloth or the like, and is applicable to a biaxial oriented film manufacturing system, an unoriented film manufacturing system or the like.

2. Description of the Prior Art

A winding system for a web-like material such as a film (hereinafter called simply "film") in which a medium such as an adhesive tape is not used on a core but a film is wrapped directly around a core (hereinafter called "tapeless winding system") has been being given attention in various fields because damage of films in inner layers of a mill roll caused by unevenness of a core surface due to an adhesive tape or the like are not present and also the work of removing remaining adhesive materials upon reuse of the core is unnecessary. However, there still remain problems resulting in scratches being generated at a cut end of a film and winding creases being generated in a mill roll formed by winding the film on a core, and therefore, development of a more complete system has been strongly desired.

SUMMARY OF THE INVENTION

It is therefore one object of the present invention to provide an improved automatic cutting and winding apparatus for a web-like material such as a film in which scratches are not generated at a cut end portion of a web-like material, uneven deformation does not occur at a cut portion of a web-like material, and creases are not generated during winding in a mill roll.

According to one feature of the present invention, there is provided a turret type automatic cutting and winding apparatus for automatically cutting and winding a web-like material such as a film by means of a press roll, press members and a cutter, in which electrostatic charging means mounted on a swingable arm for giving an electrostatic charge to a cut end portion of the web-like material and/or onto a surface of a core is provided, a cutter and a pair of press members are swingable relative to and oppose each other across the web-like material, and the arrangement is such that at a cutting position the press members may be positioned with the cutter placed therebetween.

According to another feature of the present invention, there is provided a turret type automatic cutting and winding apparatus for automatically cutting and winding a web-like material such as a film by means of a press roll, press members and a cutter, in which electrostatic charging means mounted on a swingable arm for giving an electrostatic charge to a cut end portion of the web-like material and/or onto a surface of a core is provided, a cutter and a pair of press means are swingably mounted so as to swing relative to and oppose each other across the web-like material, and the arrangement is such that at a cutting position the press members may be respectively disposed to the front of and the rear of the cutter which is preliminarily standing by.

According to still another feature of the present invention, there is provided the above-featured automatic cutting and winding apparatus for winding a web-like material such as a film, in which swing acceleration means is associated with the press members.

According to yet another feature of the present invention, there is provided the above-featured automatic cutting and winding apparatus for a web-like material such as a film, in which the cutter is provided with a heater and has a plurality of semi-circular edges that are contiguous.

According to a further feature of the present invention, there is provided a turret type automatic cutting and winding apparatus for automatically cutting and winding a web-like material such as a film by means of a press roll, support members and a cutter, in which electrostatic charging means for giving an electrostatic charge to a cut end portion of the web-like material and/or to a surface of a core is provided, a cutter and a pair of support members are swingably mounted so as to swing relative to and oppose each other across the web-like material, and the arrangement is such that at a cutting position the cutter may come in between the pair of support members which are preliminarily standing by.

According to a yet further feature of the present invention, there is provided the above-featured automatic cutting and winding apparatus for a web-like material such as a film, in which a locus of movement of the cutter during cutting extends along a surface of a core.

According to a still further feature of the present invention, there is provided the above-featured automatic cutting and winding apparatus for a web-like material such as a film, in which an expander roll, positioned close to a mill roll which is formed of the web-like material wound around a core with a small interval held therebetween so that the expander roll does not contact the mill roll, is provided.

According to the present invention, upon winding a film on a new core, a swingable arm swings, an electrostatic charge is given to a cut end portion of a film and/or onto a surface of a core by electrostatic charging means mounted on the swingable arm to make the cut end portion of the same film adhere to the surface of the core, and at the same time winding is commenced. Subsequently, upon cutting the film, a pair of press members which are opposed to a cutter with the film extending therebetween, depress the film towards the cutter while both of the press members are pressing the film, or the cutter is moved between the pair of press members, and thereby cut the film while tension in the film is increased.

In addition to the above-described operation, according to one aspect of the present invention, upon cutting a film, a pair of press members which are opposed to a cutter with the film extending therebetween are depressed at a high speed towards the cutter by swing acceleration means while both of the press members are pressing the film, thereby cutting the film while tension in the film is increased.

According to another aspect of the present invention, upon cutting a film, a cutter which is opposed to a pair of support members with the film extending therebetween comes in between the pair of support members, thereby cutting the film while tension in the film is increased.

Furthermore, according to still another aspect of the present invention, a film is cut by a cutter moving along that intercepts a surface of a core.

Also, according to yet another aspect of the present invention, an expanding capability of an expander roll positioned close to a mill roll, which is formed of a film wound around a core, with a small interval being maintained therebetween so that the expander roll does not contact the mill roll, is employed to remove creases from the film just prior to winding.

Due to the above-described constructions and operations of the automatic cutting and winding apparatus for a web-like material such as a film according to the present invention, the problems in the automatic cutting and winding apparatuses of the prior art such as the generation of scratches at a cut end portion of a web-like material, the occurrence of uneven deformation at a cut portion of a web-like material, and the generation of creases in a mill roll formed by winding a web-like material around a core, can be eliminated entirely.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIGS. 1, 2 and 3 are side views showing a first preferred embodiment of the present invention, respectively, in different states of operation;

FIGS. 8 and 9 are side views showing a third preferred embodiment of the present invention, respectively, in different states of operation;

FIGS. 17, 19 and 20 are side views showing a fifth preferred embodiment of the present invention, respectively, in different states of operation;

FIG. 21 is a side view showing a mode of operation of an essential part of the same preferred embodiment;

FIG. 22 is a plan view showing a cutting configuration at an end of a film cut by the same preferred embodiment;

FIGS. 23, 24 and 25 are side views showing a sixth preferred embodiment of the present invention, respectively, in different states of operation;

DETAILED DESCRIPTION OF THE PRIOR ART

Figure 3:
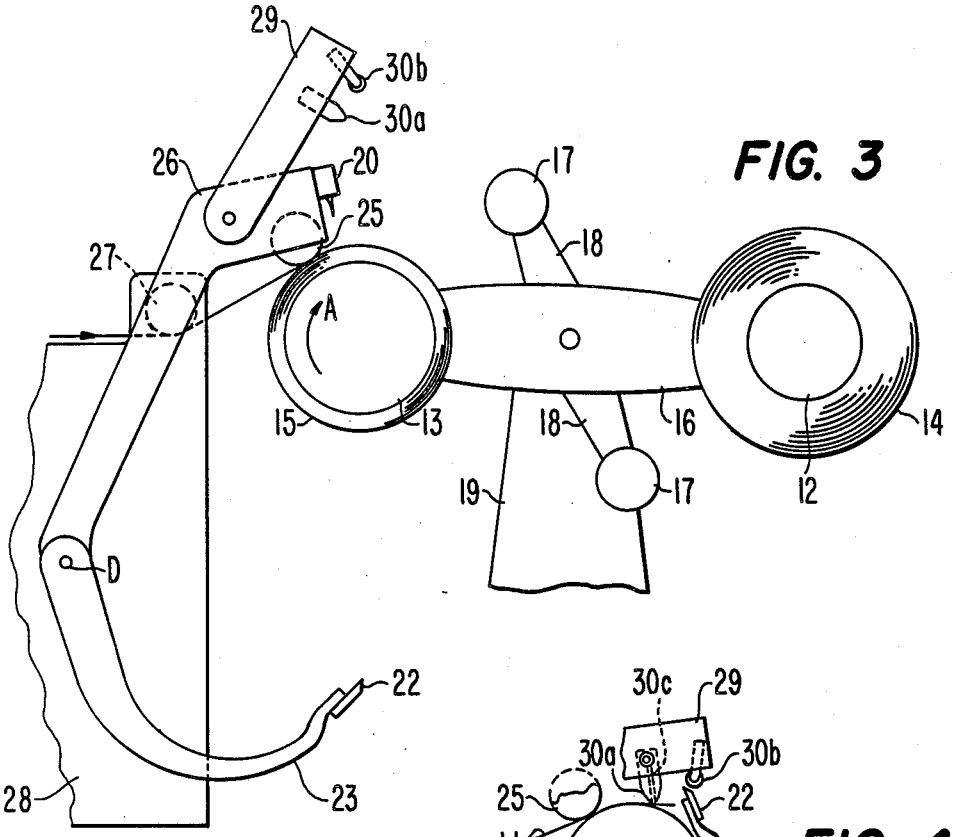

Before entering the description of the preferred embodiments of the present invention, a construction and an operation of one example of a turret type automatic cutting and winding apparatus for a film heretofore used will be described in greater detail with reference to FIGS. 29 to 34. In these figures, reference numeral 1 designates a film, reference numeral 2 designates a new core around which a cut film is to be rewound, and the core 2 is mounted on one arm of a turret 4 so as to be rotationally driven in the direction of arrow A by means of a driving device not shown. Reference numeral 3 designates a guide roll that is pivotably supported at an end of another arm **4*a* of the turret 4 that is disposed 90° from the arm on which the core 2 is mounted. Reference numeral 5 also designates a guide roll, and this guide roll 5 is pivotably supported at a film feed end of a frame 10. Additionally, there is provided a wrapping roll 6 which can be pivoted in the direction of arrow B so as to traverse a middle portion disposed between the guide roll 5 and the above-described core 2. The wrapping roll 6 is pivotably supported at a tip end of a swingable arm 7, and the other end of the same swingable arm 7 is pivotably supported at one end of the above-mentioned frame 10 on the side for winding a tape. The above-mentioned wrapping roll 6 is adapted to pivot so as to traverse the middle portion disposed between the guide roll 5 and the core 2 as described above and to reach the rear side of the core 2**.

Reference numeral 8 designates a cutter which is mounted at a tip end of an arm 9, the other end of which is likewise pivotably mounted at an appropriate position located on the frame 10. This arm 9 is swung by a driving device not shown in synchronism with the pivoting of the above-mentioned wrapping roll 6, and the cutter 8 at the tip end of the arm 9 is adapted to cut the film 1.

Figure 29:
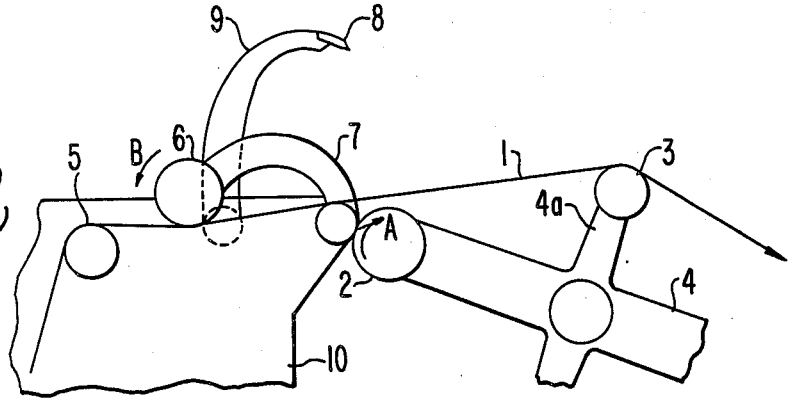
FIG. 29 (PRIOR ART)
FIG. 29 is a side view of an essential part of an automatic cutting and winding apparatus in the prior art showing an operating state in which a film is wound.
Figure 30:
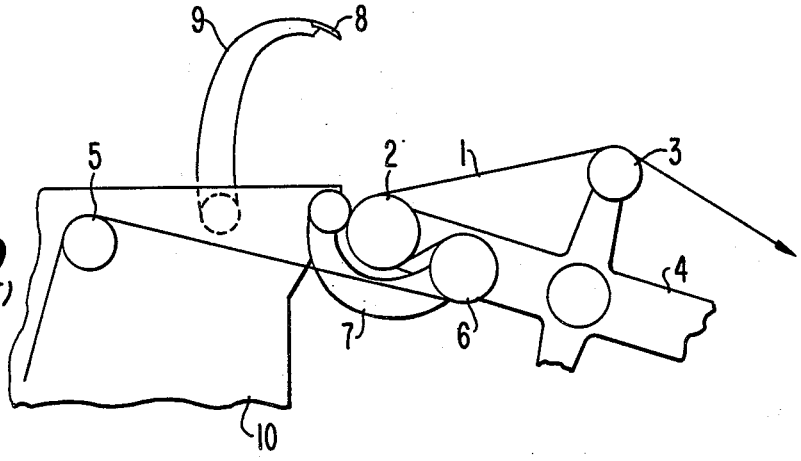
FIG. 30 (PRIOR ART)
FIG. 30 is a side view of an essential part of the same apparatus in the prior art showing a preliminary state for rewinding.

Describing now the operation of the above-described apparatus, in FIG. 29 the film 1 is being wound around a core (not shown) mounted at a remote end of the turret 4, and if a mill roll being wound around that core reaches its full volume, then the wrapping roll 6 is pivoted in the direction of arrow B so as to urge the film 1 against the core, and the state shown in FIG. 30 is attained.

Figure 31:
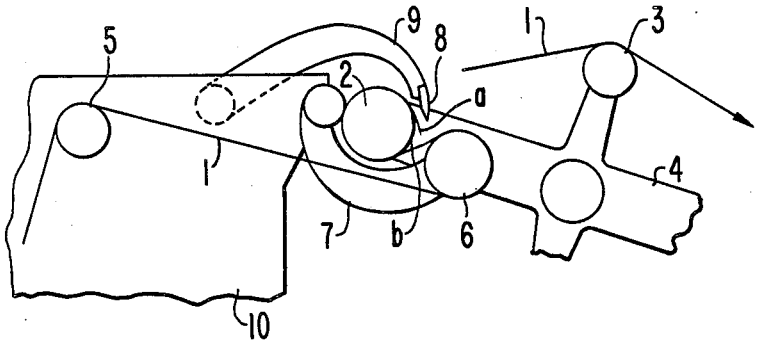
FIG. 31 (PRIOR ART)
FIG. 31 is a side view of an essential part of the same apparatus in the prior art showing a cutting state.

Subsequently, the cutter 8 descends to cut the film 1 as shown in FIG. 31, then a film end a is forced to enter a gap b between the core 2 and the wrapping roll 6, and thus, wrapping is finished.

However, in the case of the prior art apparatus as described above, in order to wrap in the cut end a of the film 1 upon winding a cut film around a new core in the above-described manner, it was necessary to embrace the core 2 with the film 1 prior to cutting as shown in FIG. 30. The film 1 is held under a predetermined tension generated between the wrapping roll 6 and the guide roll 3 in FIG. 29 for the purpose of winding, and so, in upon transferring from the state shown in FIG. 29 to the state shown in FIG. 30, it was necessary to gradually move the roll 6 over a large period of time for the purpose of preventing breaking, zig-zag traveling, the generation of creases and the like due to unnatural forces applied to the film 1.

But since the surface of the core 2 is not smooth as is the case with a smoothening roll, and since the circumferential speed of the core 2 is preset somewhat faster than the traveling speed of the film 1 in order to prevent slackening of the film immediately after the wrapping, slip would occur between the film 1 and the core 2, and hence there was a possibility that scratches could be generated on the film. Accordingly, the portion of the film scratched by the core 2 was unacceptable as a product, and moreover, there was a shortcoming in that the amount of such a loss would become larger as the film traveling speed became higher.

Figure 32:
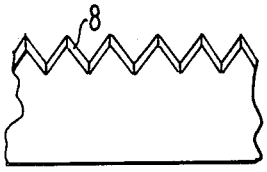
FIG. 32 (PRIOR ART)
FIGS. 32 and 33 are a plan view and a cross-section side view, respectively, of a cutter in the prior art.
Figure 33:
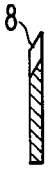
FIG. 33 (PRIOR ART)

Referring now to FIG. 31, the film 1 is supported by the core 2 and the guide roll 3, and is cut when the arm 9 descends and the cutter is brought to the film 1 as described above. It is to be noted that normally the cutter 8 employs a saw-tooth shaped blade as shown in FIGS. 32 and 33.

Figure 34:
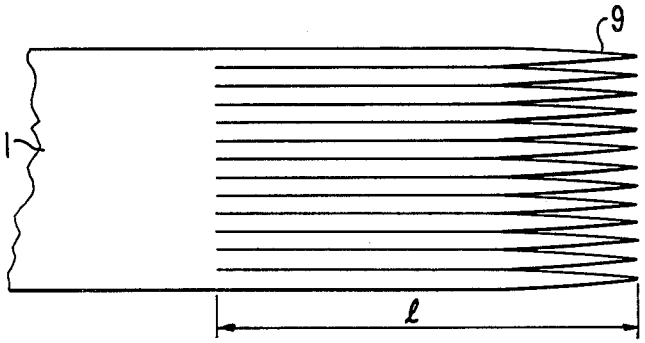
FIG. 34 (PRIOR ART)
FIG. 34 is a plan view showing a cut end configuration of a film that has been cut by the cutter in the prior art shown in FIGS. 32 and 33.

In the above-described automatic cutting and winding apparatus for a film in the prior art, in order to realize a good cutting face of a film material, countermeasures were necessary including providing an excellent cutting capability of a cutter providing, an operation speed of a cutter 8 that became faster as a traveling speed of a film became faster, increasing tension in a film or providing means for supporting a film in order that upon cutting the film can hardly escape when pressed by the cutter. In the event that these countermeasures were not provided, band-shaped cutting residuals would be produced at a cut portion 9 as shown in FIG. 34. Hence, when the cut portion is wrapped around a new core, the respective band-shaped pieces in the cut portion 9 would be folded or overlapped, resulting in unevenness. This unevenness would cause uneven deformation of a film 1 as a result of winding of the film 1 over the unevenness. Hence, flatness of a rewound film 1 would be deteriorated and many unacceptable portions would be produced. The length l of this unacceptable cut portion becomes longer as the traveling speed of the film 1 is faster, as the operating speed of the cutter is slower, and as the tension in the film is smaller, and therefore there was a shortcoming in that an unacceptable film subjected to uneven deformation could be long.

DESCRIPTION OF THE PREFERRED EMBODIMENTS

Now the present invention will be described in more detail in connection with the preferred embodiments of the invention with reference to FIGS. 1 to 28.

A first preferred embodiment of the present invention is illustrated in FIGS. 1 to 4, in which reference numeral 11 designates a film, numerals 12 and 13 designate cores, and these cores 12 and 13 are pivotably supported at opposite end portions of a turret 16 so as to be rotatable in the direction of arrows A when driven by a driving device not shown, the turret 16 being mounted on a frame 19 so as to be rotatable about its center in the direction of arrow C. In addition, arms 18 are provided on opposite sides of the central portion of the turret 16 and project therefrom, and at the respective tip end portions of the arms 18 are pivotably supported guide rolls 17, respectively. Reference numeral 14 designates a mill roll formed by winding the film 11 around the core 12.

Figure 4:
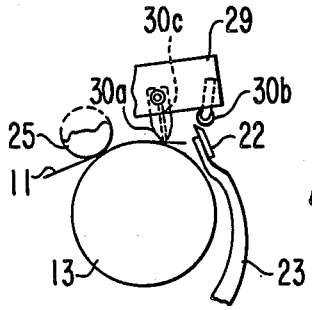
FIG. 4 is a side view of an essential part of the same preferred embodiment in which an air blow nozzle is formed in a press member.

On the film feed side of the above-described frame 19 is disposed another frame 28, on which a guide roll 27 is pivotably mounted along a film feed passageway. Also on the frame 28 adjacent to the guide roll 27, are pivotably mounted swingable arms 26 and 23 which can swing about an identical axis D. At the tip end of the swingable arm 23 is mounted a cutter 22. Also, on the swingable arm 26 are mounted a press roll 25 and electrostatic charging means 20. Furthermore, at the tip end of the swingable arm 26 is pivotably mounted an arm 29 which can likewise swing about a center point E, and at the tip end of the arm 29 are mounted a pair of press members 30 consisting of a press bar 30*a* and a press rod 30*b*. In addition, an air blow nozzle 30*c* could be formed in the press member 30 so that a film end a may be pressed against the core 13 by air as shown in FIG. 4. The above-referred electrostatic charging means 20 is a well-known corona discharge charging type, and an electrode section of an electrostatic charging device is employed therefor. It is to be noted that a power supply section and wirings of the electrostatic charging device are omitted from the illustrations.

Now description will be made as to the operation wherein tapeless winding of a film is carried out by making use of the apparatus according to the above-described embodiment of the present invention. FIG. 1 shows the state of the apparatus when the mill roll 14 on the right side core 12 as viewed in the figure has reached a full amount. The wound length of the film 11 is measured by a wound length counter not shown, and when it has reached the full amount, the arm 23 is actuated and is made to stand by at the position shown in FIG. 2. Subsequently the swingable arm 26 is actuated to press the film 11 against the new core 13 with the press roll 25. At the same time, the swingable arm 29 descends so that the pair of press members 30 depress the film 11 towards the cutter 22, and thus, the tension in the film 11 is increased to cut the film 11 momentarily.

Simultaneously with the cutting, an electric charge is given by the electrostatic charging means 20 to a cut end portion a of the film 11 to make it adhere to the core 13 for carrying out wrapping, and thus automatic cutting and winding are effected in a tapeless manner. It is to be noted that blowing of air from the air blow nozzle 30*c* in FIG. 4 is carried out simultaneously with charging by the electrostatic charging means 20.

By employing the above-described construction, in order to minimize the film cut end a, the stop position of the cutter 22 can be made as close as possible to the core 13 as shown in FIG. 2. In addition, by pivotably mounting the arm 29, which is short and light, at the tip end portion of the arm 26, high-speed cutting becomes possible with a small swinging operation. Subsequently, when the winding has been finished, the arms 23 and 26 are actuated to return them to the state shown in FIG. 3, and winding of the film 11 for producing a mill roll 15 is carried out on the new core 13.

In the above-described embodiment, the press roll 25 can be used as a lay-on roll for controlling a winding tightness of a mill roll. Furthermore, as the electrostatic charging means, air blow type electrostatic charging means could be employed. The interval between the press bar 30*a* and the press rod 30*b* could be made variable so that the apparatus can be adjusted to accomodate for a change in the type and thickness of the film, and the air blow nozzle can be provided separately from the press members 30.

Figure 5:
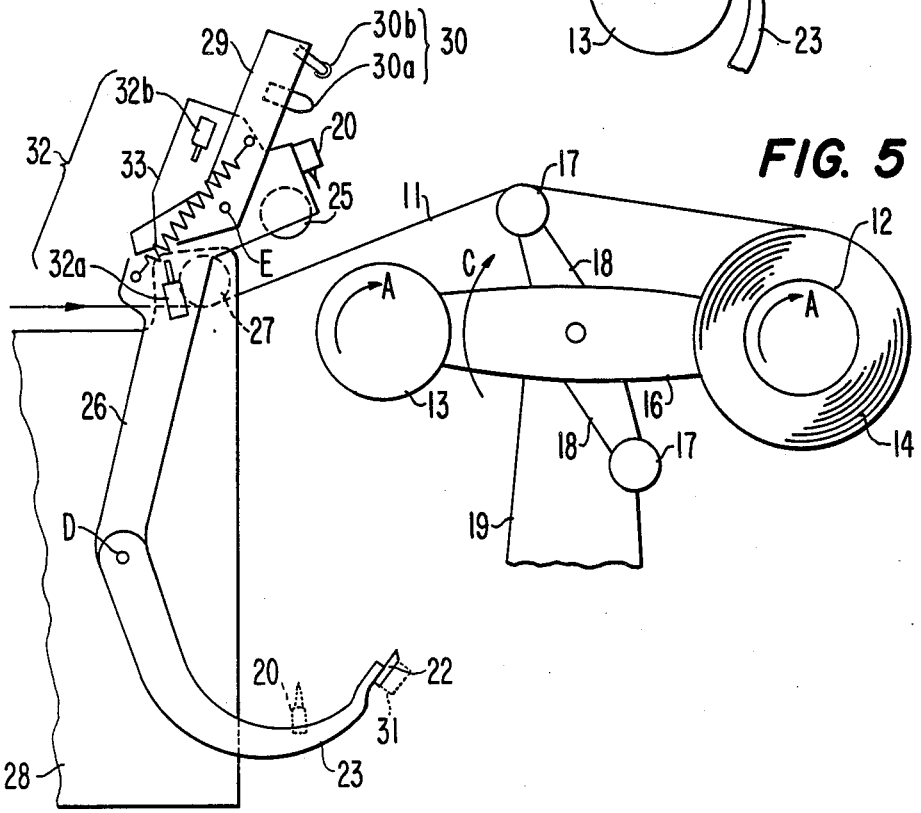
FIGS. 5, 6 and 7 are side views showing a second preferred embodiment of the present invention, respectively, in different states of operation.

Now a second preferred embodiment of the present invention will be described with reference to FIGS. 5 to 7.

This preferred embodiment is similar to the embodiment shown in FIGS. 1 to 4 except for the following points. That is, on the swingable arm 26 are mounted press cylinders 32 consisting of two sets of air cylinders 32*a* and 32*b* and electrostatic charging means 20. In addition, the arm 29 is coupled to the arm 26 via a spring 33. On the same arm 26 are provided anti-impact support members (not shown) for supporting the arm 29 in the state shown in FIG. 5 or 6, and the press cylinders 32 and the spring 33 jointly form swing acceleration means. A heater 31 is mounted on the lower surface of the cutter 22 to heat the cutter up to a temperature higher than a melting point of the film. Furthermore, on the swingable arm 23 is mounted electrostatic charging means 20 for giving an electric charge to the surface of the core 13.

Description will be made as to the operation of the illustrated apparatus when carrying out tapeless winding of the film 11. FIG. 5 shows the state of the apparatus at the time when the mill roll 14 on the right side core 12 as viewed in the figure has reached a full amount. The wound length of the film 11 is measured by a wound length counter not shown, and when it has reached the full amount, the arm 23 is actuated to make the cutter 22 stand by at the position shown in FIG. 6, subsequently the swingable arm 26 is actuated to press the film 11 against the new core 13 by means of the press roll 25. At the same time, in response to a signal issued from a control device not shown the air cylinder 32*a* is actuated to project a rod that pushes up the arm 239 to cause the arm 29 to rotate in the clockwise direction about a center point E, and so, the arm 29 rotates while increasing a deformation of the spring 33 until a dead point of the spring 33 is passed. Once the arm 29 has passed the dead point of the spring 33, a restoring force of the spring 33 will accelerate the projecting motion imparted by the air cylinder 32*a* to the arm 29, and hence the arm 29 will accelerate rapidly to the cutting position shown in FIG. 6. That is, the pair of press members 30 mounted at the tip end of the arm 29 depress the film 11 at a high speed towards the cutter 22, and the film 11 is cut while the tension in the film is increased.

Simultaneously with this cutting, an electric charge is given by the electrostatic charging means 20 to a cut end portion a of the film and/or to a surface of the core 13, to make the cut end portion a adhere to the core 13 for wrapping, and thus, automatic cutting and rewinding are carried out in a tapeless manner.

Figure 6:
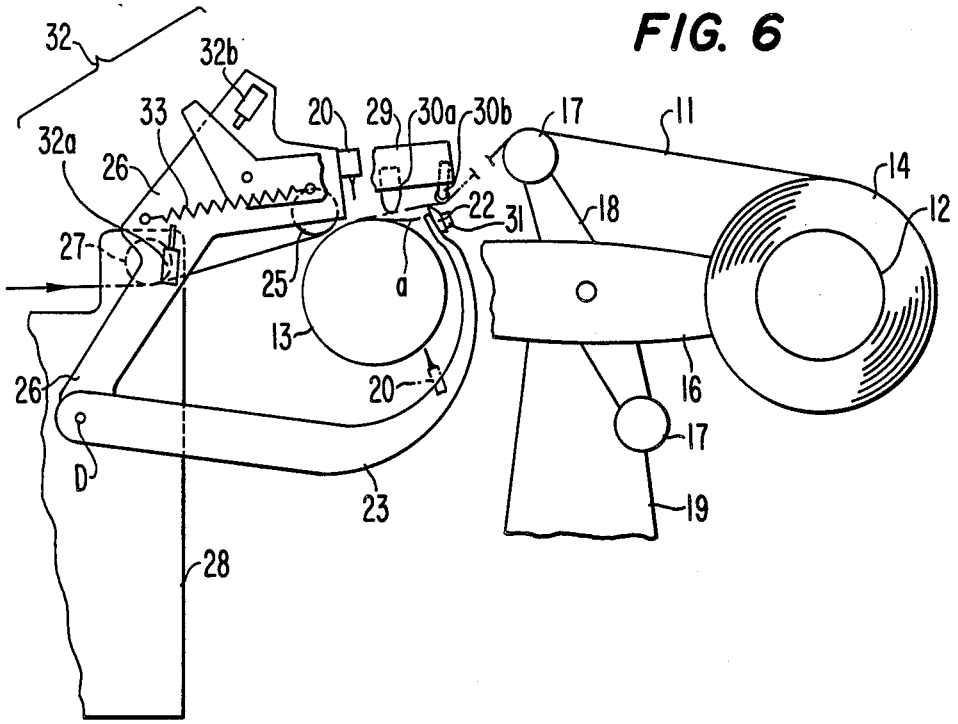
Figure 7:
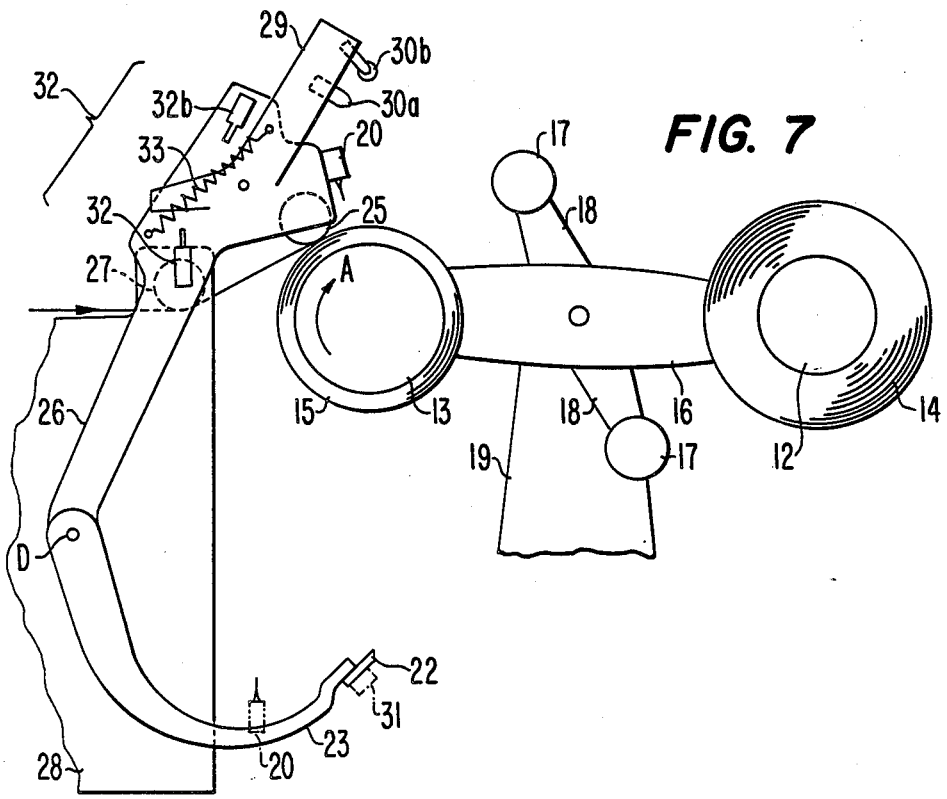

By employing the above-described construction, as shown in FIG. 6, the stop position of the cutter 22 can be brought as close as possible to the core 13 for the purpose of minimizing the cut end portion a of the film 11. In addition, due to the fact that the arm 29 having a short arm length and a light weight is pivotably mounted at the tip end portion of the arm 26 and also the cylinders 32 and the spring 33 are used in combination in the above-described manner, high-speed cutting becomes possible with a small swinging operation. Subsequently, when the wrapping has been finished, the arm 23 is actuated to be restored to the state shown in FIG. 7, the air cylinder 32*b* is actuated to rotate the arm 29 in the anti-clockwise direction until it is restored to the state shown in FIG. 7, and winding of the film 11 for producing the mill roll 15 is carried out on the new core 13.

In the above-described embodiment, the press roll 25 can be used as a lay-on roll for controlling a winding tightness of a mill roll. Furthermore, as the electrostatic charging means, an air blow type electrostatic charging means could be employed. The interval between the press bar 30*a* and the press rod 30*b* could be made variable so that the apparatus can be adjusted to accomodate for a change in the type and thickness of the film, and the air blow nozzle can be provided separately from the press members 30.

In the following, a third preferred embodiment of the present invention will be described with reference to FIGS. 8 to 12.

This preferred embodiment is similar to the embodiment shown in FIGS. 1 to 4 except for a cutter 122 and a heater 131 as will be described hereunder and shown in FIGS. 8 and 9.

Figure 10:
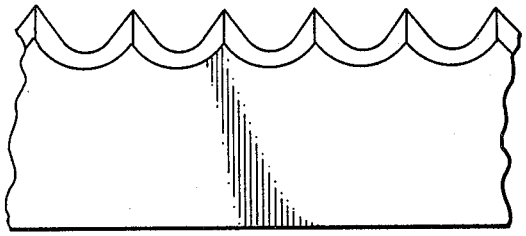
FIGS. 10 and 11 are a front view and a cross-section side view, respectively, of a cutter used in the third preferred embodiment.
Figure 11:
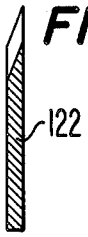
Figure 12:
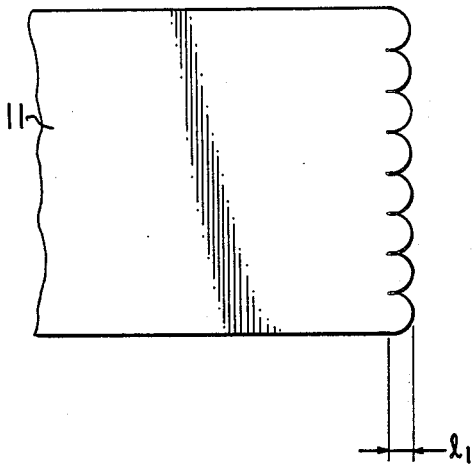
FIG. 12 is a plan view showing a cut end configuration of a film that has been cut by the cutter shown in FIGS. 10 and 11.

More particularly, a cutter 122 having a plurality of semi-circular edges as shown in FIGS. 10 and 11 and a heater 131 are mounted at the tip end of the arm 23. In this preferred embodiment, upon cutting a film, as shown in FIG. 9, the swingable arm 26 is actuated to press the film 11 against the new core 13 by means of the press roll 25. At the same time, the swingable arm 29 descends so that the pair of press members 30 depress the film 11 towards the cutter 122 which has been heated by the heater 131, and the film 11 is cut while a tension in the film 11 is increased. In this instance, since the cutter 122 has been heated to a temperature higher than a melting point of the film, the film is momentarily cut by melting, and also since the edges of the cutter 122 is have a semi-circular shape, the cut end portion of the film has the configuration shown in FIG. 12. Hence, a cut length $l_1$ is negligibly short, and can be formed into a stable favorable shape.

Next, a fourth preferred embodiment of the present invention will be described with reference to FIGS. 13 to 16.

In these figures, reference numeral 11 designates a film, numerals 12 and 13 designate cores, and these cores 12 and 13 are pivotably supported from the opposite end portions of a turret 16 so as to be rotatable in the direction of arrow A when driven by a driving device not shown. The turret 16 is mounted on a frame 19 so as to be rotatable about its center in the direction of arrow C. In addition, arms 18 are provided on opposite sides of the central portion of the turret 16 and project therefrom, and at the tip end portions of the arms 18 are pivotably supported guide rolls 17, respectively. Reference numeral 14 designates a mill roll formed by winding the film 11 around the core 12.

Figure 16:
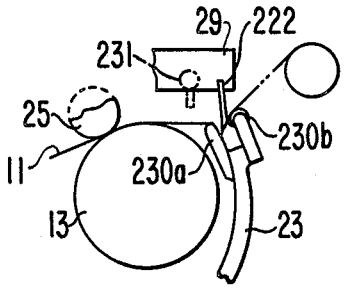
FIG. 16 is a side view of an essential part of the same preferred embodiment in which an air blow nozzle is disposed on a swingable arm.

On the film feed side of the above-described frame 19 is disposed another frame 28, on which a guide roll 27 is pivotably mounted along a film feed passageway. Also on the frame 28, adjacent to the guide roll 27 are pivotably mounted swingable arms 26 and 23 which can swing about a same axis D. At the tip end of the swingable arm 23 are mounted a pair of support members 230 consisting of a support bar 230*a* and a support rod 230*b*. Also, on the swingable arm 26 are mounted a press roll 25 and electrostatic charging means 20. This electrostatic charging means 20 could be mounted on the swingable arm 23. Furthermore, at the tip end of the swingable arm 26 is pivotably mounted an arm 29 which can likewise swing about a center point E, and at the tip end of the arm 29 is mounted a cutter 222. In addition, an air blow nozzle 231 could be mounted at the tip end of the swingable arm 29 so that a film end a may be pressed against the core 13 by air as shown in FIG. 16.

Figure 13:
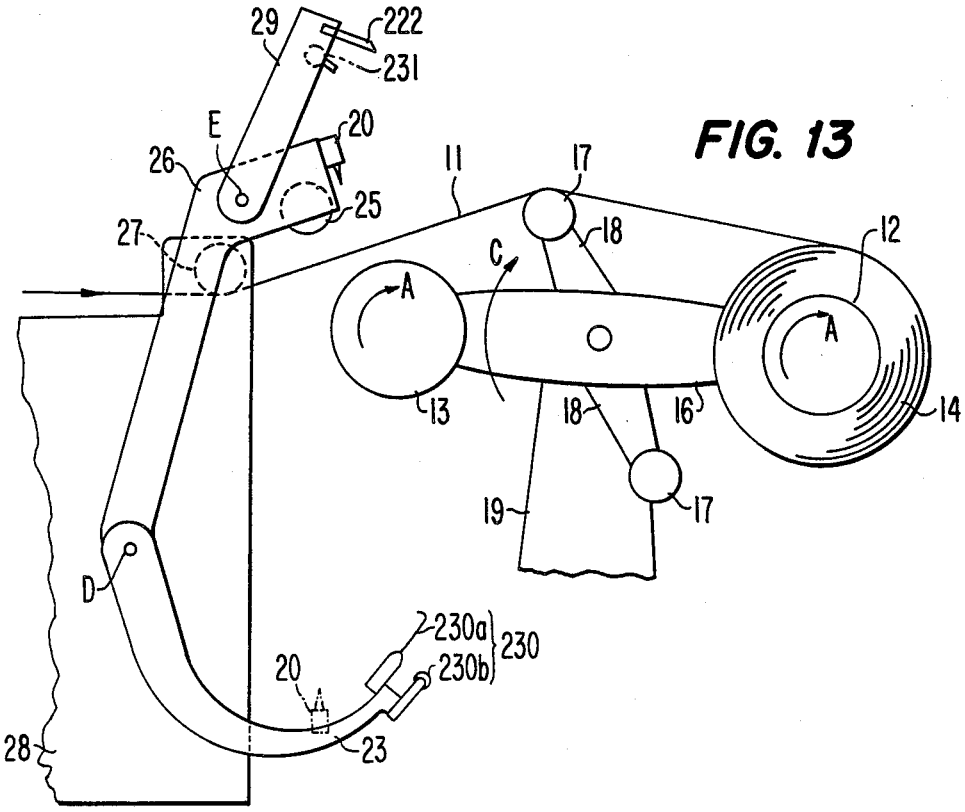
FIGS. 13, 14 and 15 are side views showing a fourth preferred embodiment of the present invention, respectively, in different states of operation.

Now description will be made as to the operation in which tapeless winding of a film is carried out by making use of the apparatus according to the embodiment of the present invention described above. FIG. 13 shows the state of the apparatus at the time when the mill roll 14 on the right side core 12 as viewed in the figure has reached a full amount. The wound length of the film 11 is measured by a wound length counter not shown, and when it has reached the full amount, the arm 23 is actuated to make the support members 230 stand by at the position shown in FIG. 14. Subsequently, the swingable arm 26 is actuated to press the film 11 against the new core 13 with the press roll 25, and at the same time the swingable arm 29 descends so that the cutter 222 presses the film 11 against the pair of support members 230*a* and 230*b* to cut the film 11 while tension in the film is increased.

Simultaneously with the cutting, an electric charge is given by the electrostatic charging means 20 to a cut end portion a of the film and/or to a surface of the core to make the film cut end a adhere to the core 13 for carrying out wrapping, and thus automatic cutting and winding are effected in a tapeless manner. It is to be noted that blowing of air from the air blow nozzle 231 in FIG. 16 is carried out simultaneously with the charging by the electrostatic charging means.

Figure 14:
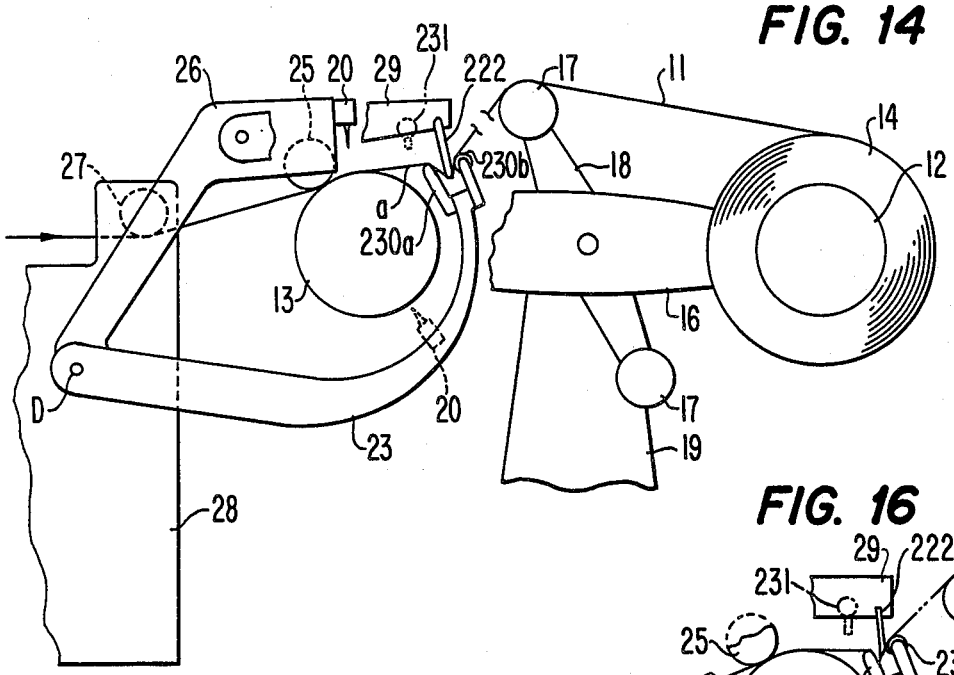

By employing the above-described construction, in order to minimize the cut end portion a of the film, the pair of support members 230 can be brought as close as possible to the core 13 as shown in FIG. 14. In addition, by pivotably mounting the arm 29, which is short in arm length and light in weight, at the tip end portion of the arm 26, high-speed cutting becomes possible with a small swinging operation.

Figure 15:
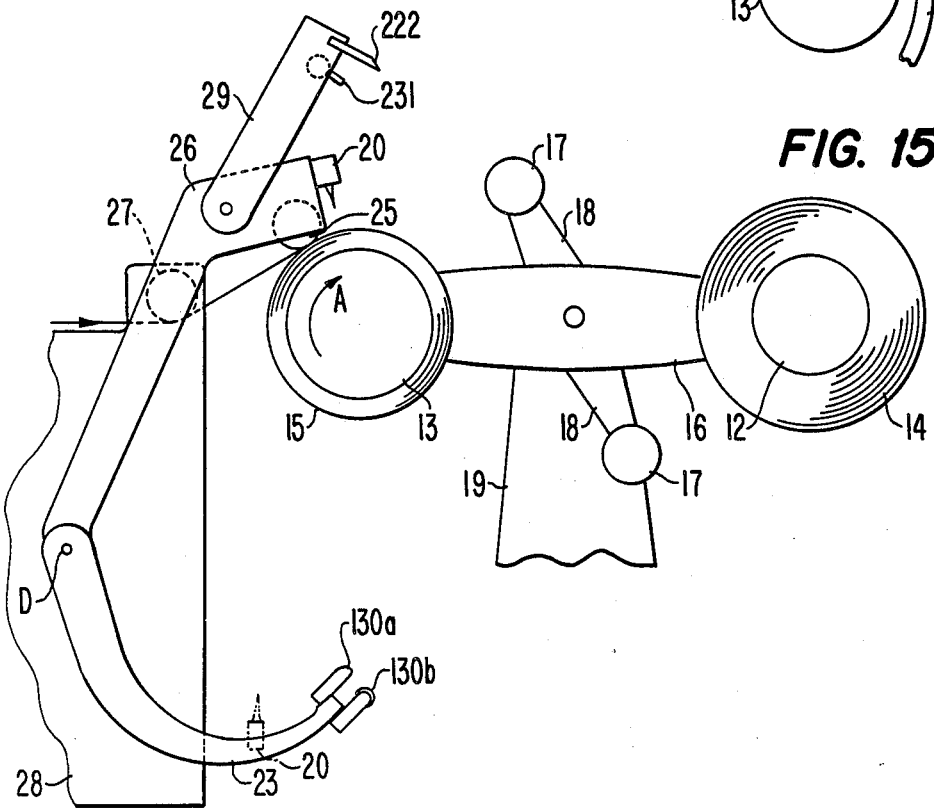

Subsequently, when the wrapping has been finished, the arms 23 and 26 are actuated to return to the state shown in FIG. 15, and winding of the film 11 for producing a mill roll 15 is carried out on the new core 13.

In the above-described embodiment, the press roll 25 can be used as a lay-on roll for controlling a winding tightness of a mill roll. Furthermore, as the electrostatic charging means, an air blow type electrostatic charging means could be employed.

Now, a fifth preferred embodiment of the present invention will be described with reference to FIGS. 17 to 22.

This preferred embodiment is a modification of the fourth preferred embodiment shown in FIGS. 13 to 16 in which a locus of movement of the cutter extends along the surface of the core, and the respective members as explained hereunder are added to the fourth preferred embodiment.

More particularly, as shown in FIGS. 17 to 20, a support member 324 is mounted at the tip end of the swingable arm 23.

On the swingable arm 26, in addition to the press roll 25 and the electrostatic charging means 20, an air cylinder 331, a sector gear 333 adapted to swing about a center point E, and a pinion 329 pivotably supported at the tip end F, are provided. An arm 330 is fixedly secured to the pinion 329, and at the tip end of the arm 330 is mounted a cutter 322. It is to be noted that electrostatic charging means 20 could be mounted to the swingable arm 23. The air cylinder 331, sector gear 333, pinion 329, arm 330 and cutter 322 can be provided independently of the pivot axis D.

Figure 17:
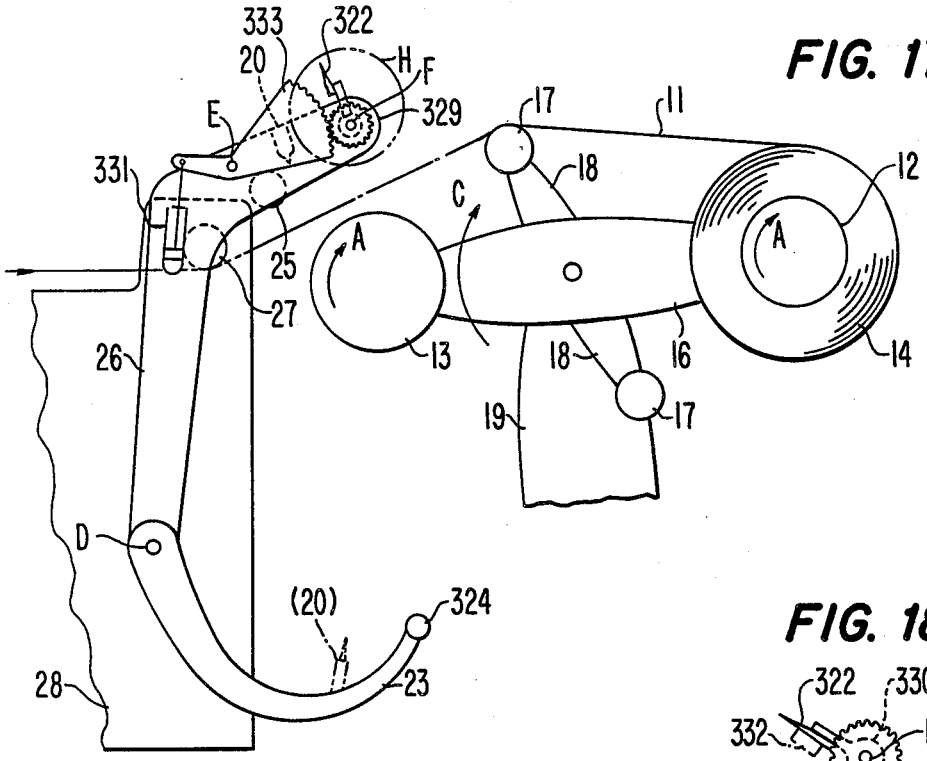
Figure 18:
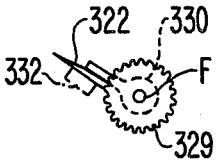
FIG. 18 is a detailed side view of a portion encircled at H in FIG. 17.
Figure 19:
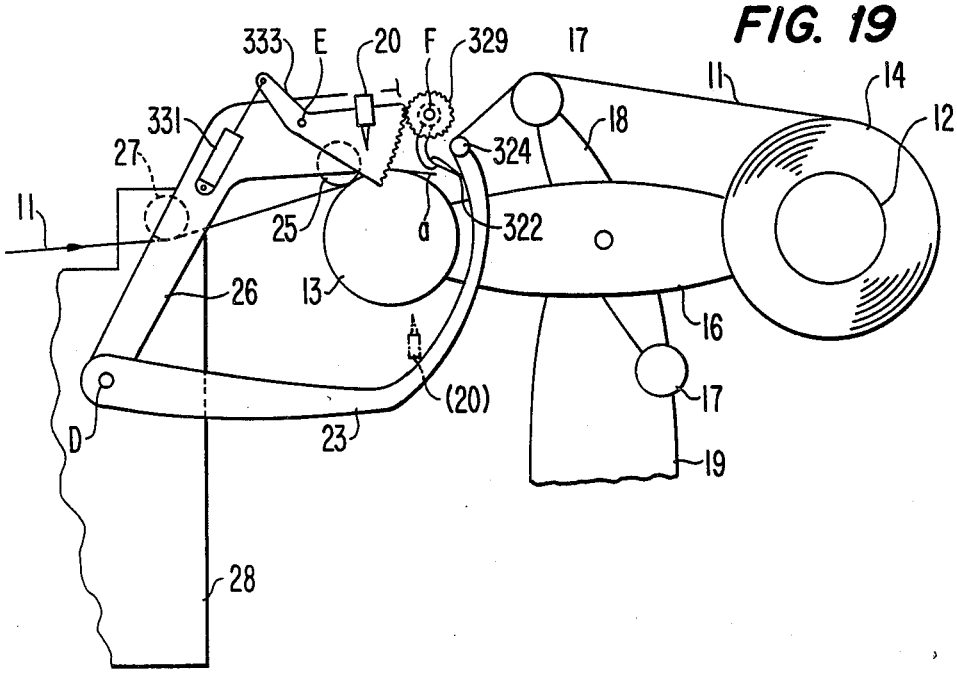

Next, description will be made as to the operation in which tapeless winding of the film 11 is carried out by the apparatus according to the described above embodiment of the present invention. FIG. 17 shows the state of the apparatus at the time when the mill roll 14 on the right side core 12 as viewed in the figure has reached a full amount. The wound length of the film 11 is measured by a wound length counter not shown, and when it has reached the full amount, the arm 23 is actuated to make the support member 324 stand by at the position shown in FIG. 19. Subsequently, the swingable arm 26 is actuated to press the film 11 against the new core 13 with the press roll 25, and at the same time the air cylinder 331 is actuated. Then, the arm 330 is accelerated via the sector gear 333 and the pinion 329. Hence, the cutter 322 moves at a high speed along the locus shown in FIG. 21, and it cuts the film 11 while tension in the film is increased. Accordingly, the cut edge of the film 11 is improved as shown in FIG. 22, and an unacceptable portion of the film can be extremely reduced.

In addition, if the support member 324 is brought as close as possible to the core 13 and the distance between the press roll 25 and the support point for the film is made short when the film is to be cut, then the tension of the film at cutting is higher, and the film can be cut easily and finely. It is to be noted that in order to enhance the cutting speed, the movements of the support member 324 and the cutter 322 could be synchronized. Also, for the purpose of improving the cutting efficiency, a heater (heating device) 332 could be associated with the cutter 322 as shown in FIG. 20.

Simultaneously with the cutting, an electric charge is given by the electrostatic charging means 20 to a cut end portion a of the film and/or to a surface of the core to make the film cut end a adhere to the core 13 for carrying out wrapping, and thus automatic cutting and winding are effected in a tapeless manner. Due to the employment of the structure in which rotation is given to only the cutter portion, the cutter portion can be made light in weight. More particularly, since the only parts that are required to be moved for cutting are the cutter 322, the air cylinder 331, the sector gear 333 and the small arm 330, by appropriately selecting a lever ratio with respect to the air cylinder, the cutting speed and the cutting capability can be easily enhanced.

Subsequently, when the wrapping has been finished, the arm 23 and the cutter 322 are restored to the state shown in FIG. 20, and winding of the film 11 for producing a mill roll 15 is carried out on the new core 13.

Next, a sixth preferred embodiment of the present invention will be described with reference to FIGS. 23 to 28.

Figure 27:
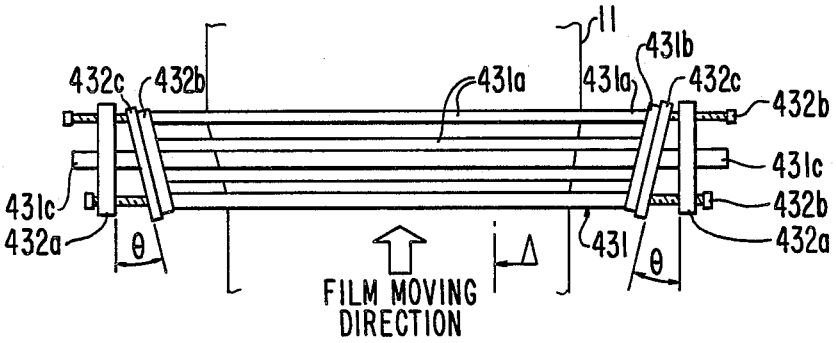
FIG. 27 is a schematic view showing an essential part of the same preferred embodiment.
Figure 28:
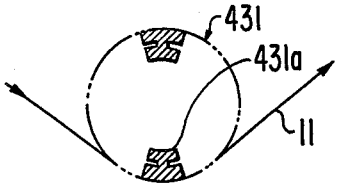
FIG. 28 is a schematic view as viewed in the direction of the arrow A in FIG. 27.

Except for an expander roll and a control mechanism therefor, this preferred embodiment is similar to the first preferred embodiment illustrated in FIGS. 1 to 4. More particularly, on the frame 28 is pivotably mounted a swingable arm 432 which can swing about a center point F, and at the tip end of the swingable arm 432 is pivotably supported an expander roll 431. A detailed structure of the expander roll 431 is shown in FIGS. 27 and 28. Tip ends of an appropriate number of adjusting bolts 432*b* threadedly penetrating left and right brackets 432*a* which are fixed to the swingable arm 432, are held in contact with inclined cams 432*c*, and these cams 432*c* can be adjusted to various inclination angles one of which is indicated by $\theta$ shown in FIG. 27 by manipulating the adjusting bolts 432*b*. A shaft 431*c* of left and right ribs 431*b* each having a plurality of radial parts, extends externally through center holes in the cams 432*c* and is pivotably supported by the brackets 432*a*. The ribs 431*b* are accommodated in annular grooves of the cams 432*c* so as to be slidable along the grooves. The ribs 431*b* and the shaft 431*c* are so connected with each other that the ribs 431*b* can rotate in the inclined annular grooves of the cams 432*b* when ribs 431*b* rotate with the shaft 431*c*. Opposite ends of a plurality of rubber bands 431*a* having the cross-sections shown in FIG. 28 are mounted to the radial parts of the left and right ribs 431*b*, respectively, at equal angular intervals.

Figure 26:
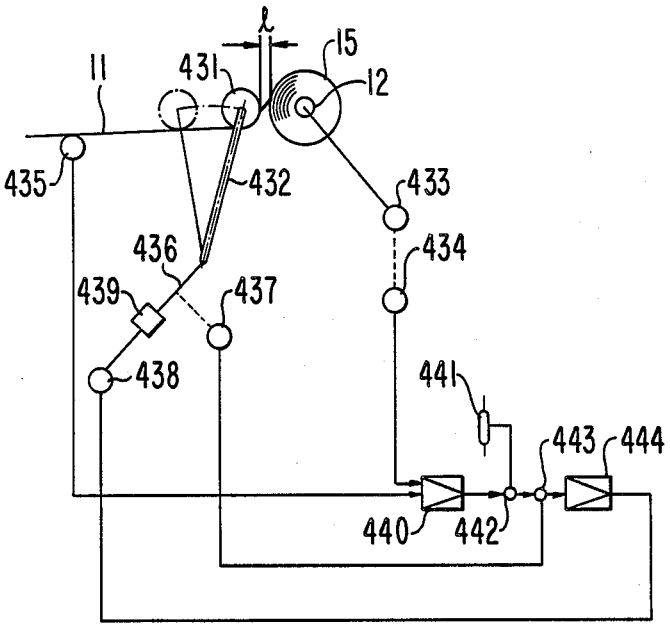
FIG. 26 is a schematic block diagram of a position control mechanism for an expander roll in the same preferred embodiment.

A control mechanism for the position of the above-described expander roll will be explained with reference to FIG. 26.

A core 12 is adapted to be rotated by a variable speed motor 433, and a rotational speed detector 434 coupled to the variable speed motor 433 for detecting the rotational speed of the motor 433 is provided. Reference numeral 435 designates a speed detector for detecting a winding speed, i.e., a traveling speed of a film, numeral 431 designates an expander roll that is rotatably supported by an arm 432, and this arm 432 is formed integrally with a shaft 436. Reference numeral 437 designates an angle detector for detecting an angular position of the shaft 436, and numeral 438 designates a motor which rotates the above-mentioned shaft 436 via a reduction gear 439 and thus the arm 432 is swung about an axis of the shaft 436. It is to be noted that the above-described shaft 436, angle detector 437, motor 438 and reduction gear 439 are supported by means not shown.

In addition, reference numeral 440 designates a wound film diameter detector, numeral 441 designates a gap setter for setting the distance of a gap extending between the surfaces of the expander roll 431 and the mill roll 15, numeral 442 designates an adder, numeral 443 designates a comparator and numeral 444 designates a controller coupled to the motor 433.

Figure 24:
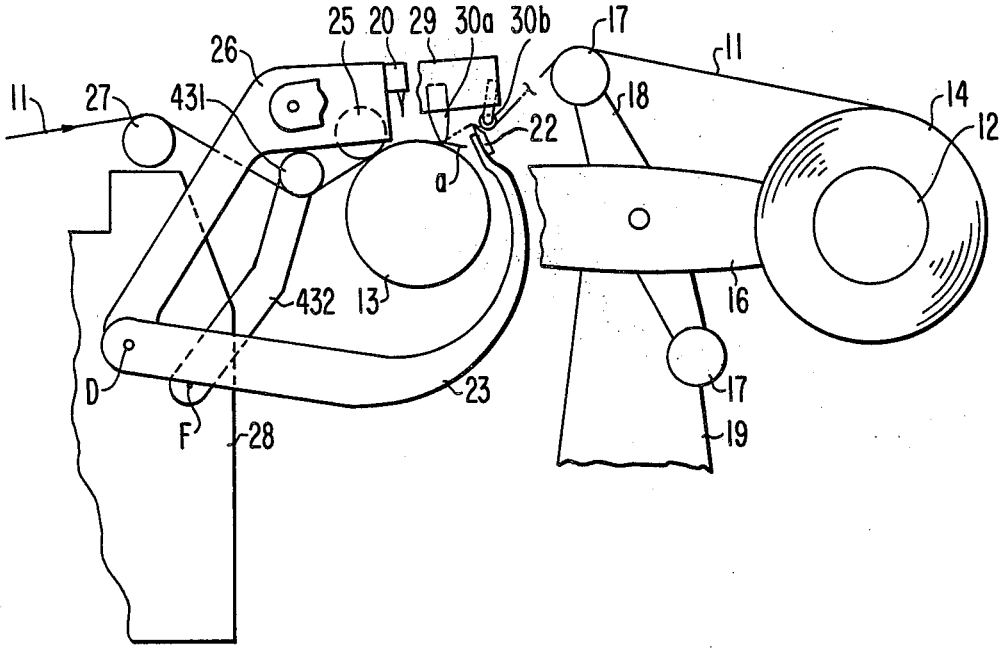
Figure 25:
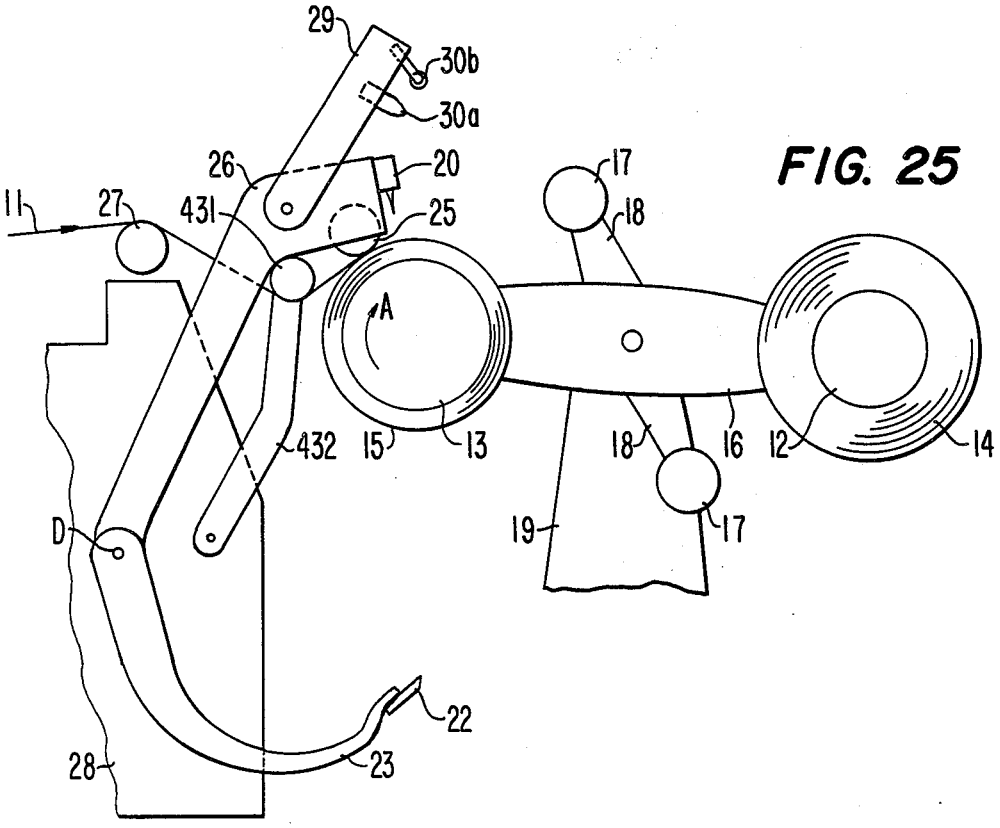

The operations of rewinding and cutting a film are shown in FIGS. 23 and 24, but since the operations are similar to those in the first preferred embodiment described above, further explanation thereof will be omitted. Once the cutting and rewinding of the film has been finished, the film 11 would be wound around a new core 13 after it passes over a guide roll 27 and comes into contact with the expander roll 431.

In this instance, in the expander roll 431, since the inclined cams 432*c* are inclined at an appropriate angle by manipulating the adjusting bolts 432*b*, the ribs 431*b* slide along the annular grooves in the cams 432*c* and the rubber bands 431*a* of the expander roll 431 stretch and contract as the expander roll 431 rotates. As shown in FIG. 27, by fastening the adjusting bolts 432*b* on the inlet side for the film 11 and by loosening the bolts 432*b* on the outlet side, the rubber bands contract on the inlet side for the film and stretch on the outlet side. Hence, the film 11 coming into contact with these rubber bands 431*a* is stretched uniformly by the stretching and contracting of the rubber bands 431*a*, and thus, longitudinal creases generated on the film 11 can be removed.

Moreover, as will be explained in the following, the expander roll 431 is positioned so as not to come into contact with the mill roll, and also upon winding of the film, so as to come close to the mill roll with a fixed minute interval always maintained between it and the mill roll. Therefore, a film path through the interval can always be maintained from the beginning of winding up to the end of winding. Accordingly, longitudinal creases generated would be removed just prior to the winding of the film, and the generation of winding creases in a mill roll can be prevented in general. As a result, an excellent mill roll that is free from winding creases, can be formed.

The position control for the expander roll 431 will be described with reference to FIG. 26. A film 11 is wound around the core 13 that is driven by the high-speed motor 433, via the speed detector 435 and the expander roll 431. When the film 11 begins to be wound around the core 13, the expander roll 431 placed at the position indicated by double-dot chain lines in FIG. 26 is advanced to the position indicated by solid lines, and expander roll 431 stops so as to establish a gap width (a dimension l in FIG. 26) that is preset by the gap setter 441.

A film winding speed is detected by the speed detector 435, a rotational speed of the mill roll is detected by the rotational speed detector 434, the respective speeds are input to the wound film diameter detector 440, in which the wound film diameter of the mill roll 15 is calculated through an electrical process, and the calculated value is input to the adder 442 as a reference position instruction adapted for the expander roll 431. It is to be noted that the calculation of the wound film diameter of the mill roll 15 is conducted according to the following formula:

$$D = 1/\pi \cdot (V/N)(m)$$

that is, $$D \propto V/N$$

where

V: film speed (m/min.)

N: rotational speed of a mill roll (r.p.m.)

$\pi$: the circular constant (dimensionless)

D: wound film diameter of a mill roll (m)

In the adder 442, the reference position instruction value sent from the wound film diameter detector 440 and the preset gap value sent from the gap setter 441 are added together, and the sum is input to the comparator 443 as a control position instruction for the expander roll 431. On the other hand, the angle detector 437 detects the position of the expander roll 431 via the arm 432 and the shaft 436, and the position information is fed back to the comparator 443. In the comparator 443, the control position instruction sent from the adder 442 is compared with the position information sent from the angle detector 437.

Furthermore, the electrical signal generated as a result of comparative operations in the comparator 443 is input to the controller 444, in which it is determined whether or not the expander roll 431 is placed at a predetermined position. If the expander roll 431 has been advanced too much, a retract signal is applied to the motor 438, while if it has advanced insufficiently, an advance signal is applied to the motor 438, and in this way automatic control for the position of the expander roll 431 is effected. Thus, the diameter of the mill roll, which increases as time elapses, is detected and the film 11 is wound around the core 13 while controlling the position of the backwardly moving expander roll 431 so that the preset gap width l is always maintained constant. Once a predetermined amount of film 11 has been wound around the core 13, the expander roll 431 is retracted to the position (the position shown by double-dot chain lines in FIG. 26) where the expander roll 431 does not hinder the rotation of the turret 16. It is to be noted that the above-described position control is effected by a closed-loop control system consisting of the rotational speed detector 434, speed detector 435, wound film diameter detector 440, gap setter 441, adder 442, angle detector 437, comparator 443, controller 444, motor 438, reduction gear 439 and shaft 436. The control system should not be limited to that illustrated in FIG. 26, but can be made modified to include one in which, for example, the mechanical rotary structure coupling the motor 438, reduction gear 439, shaft 436 and arm 432 is replaced by a hydraulic or pneumatic rotary structure or reciprocating structure.

As described above, in the last-mentioned preferred embodiment, since the expander roll 431 is spaced from the mill roll by a fixed small interval from the beginning of winding of the film up to the end of winding and just before the film is wound around the core 13, longitudinal creases produced so far in the film can be removed, generation of winding creases in the mill roll 15 can be prevented, and consequently, excellent mill rolls which are free from winding creases can be formed.

As described in detail above, according to the present invention, since winding of a film can be carried out with a cut end of the film adhering to a core by giving an electric charge to the film simultaneously with the cutting of the film, there is no need to embrace a core with the film before cutting. Hence, the film portion at the end of winding of a mill roll which comes into contact with a core and which is subjected to scratches and is wasted, is eliminated, and therefore, a yield of the film can be greatly improved.

In addition, since a pair of press members for pressing a film against a cutter and a cutter coming into press contact with a film for cutting the film oppose each other with the film extending therebetween, tension in the film upon cutting is increased by the pair of press members. Moreover, since the pair of press members press the film so as not to move away from the cutter, a cut end of the film can have a good cutting configuration. Therefore, there is an advantage in that an unacceptable portion of a film wound in a mill roll can be remarkably reduced. The above-mentioned advantage becomes more remarkable as the cutting and winding speed becomes higher.

Also, according to the present invention, since a pair of press members for pressing a film against a cutter and a cutter coming into press contact with a film for cutting the film oppose each other with the film extending therebetween and also a device for increasing a swinging speed of the press members is provided, tension in the film upon cutting is increased by the pair of press members. Moreover, since the pair of press members press the film so as not to move away from the cutter, high speed cutting becomes possible, and a cut end of the film can have a good cutting configuration. Furthermore, by heating a cutter up to a temperature higher than a melting point of a film by means of a heater mounted to the cutter, the cutting can be made reliable.

Furthermore, according to the present invention, by employing a cutter having a plurality of contiguous semi-circular edges as a heatable cutter, cutting of a film can be achieved reliably and with a reduced cut end length.

Moreover, according to the present invention, since a pair of support members and a cutter coming into press contact with a film for cutting the film oppose each other with the film extending therebetween and the cutter moves in between the pair of support members to cut the film, a tension in the film upon cutting is increased. Furthermore, since the pair of support members press the film so as not to move away from the cutter, a cut end of the film can have a good cutting configuration.

Also, according to the present invention, since a cutter rotary shaft is provided for a cutter adapted to come between the pair of support members so that the cutter can move at a high speed along a surface of a core, upon the cutting of a film, a cut end of the film is guided so as to extend along the core and floating of the film from the core is reduced. Therefore, simultaneously with the cutting, the film is adhered smoothly onto the surface of the core, and separation or floating of the film cut end from the core surface does not occur. This perfectly eliminates a fold-back phenomena of the cut end of the film, creases caused by folding back can be preliminarily prevented, and therefore, the present invention can provide great advantages in that a yield of a mill roll is improved. In addition, since support members and a cutter are disposed in the proximity of a cutting position of a film and each other with a film extending therebetween and a cutting speed is raised, the film can be cut by the cutter without being broken and the cut end portion of the film can have an improved configuration shown in FIG. 22. Consequently, there is an advantage in that an unacceptable portion of a film can be remarkably reduced. The above-mentioned advantage becomes more remarkable as the cutting and winding speeds become higher.

Furthermore, according to the present invention, since winding is effected while removing longitudinal creases generated by means of an expander roll just before the film is wound around a core, excellent mill rolls which are free from creases can be obtained. Consequently, there is an advantage in that an unacceptable portion of a film can be remarkably reduced. The above-mentioned advantage becomes more remarkable as the cutting and winding speeds become higher and as the width of the film becomes broader.

Since many changes and modifications in design can be made to the above-described construction without departing from the spirit of the present invention, it is intended that all matter contained in the above description and illustrated in the accompanying drawings shall be interpreted to be illustrative and not in a limiting sense.

What is claimed is:

1. In a turret type automatic cutting and winding apparatus for automatically cutting continuous web-like material and for winding the web-like material onto a core rotatably supported on a turret, the improvement comprising:

a frame;

a swingable arm connected to the frame;

an electrostatic charging means mounted to said swingable arm for applying an electrostatic charge to at least one of the entirety of a cut end portion of the web-like material extending across the entire width thereof and the core around which the web-like material is moved;

a cutter movable to a cutting position for cutting the web-like material across the entire width thereof to produce the cut end portion thereof, and means connected to said cutter and said frame for swinging said cutter relative to said frame to said cutting position; and a pair of press members connected to the frame and movable to the cutting position at which the press members press against the web-like material, and means connected to said press members for supporting the press members on an opposite side of the web-like material from said cutter and for swinging said press members relative to said frame to said cutting position, said cutter disposed between said press members when the cutter and the press members are at said cutting position.

2. In a turret type automatic cutting and winding apparatus for automatically cutting continuous web-like material and for winding the web-like material onto a core rotatably supported on a turret, the improvement comprising:

a frame;

a swingable arm connected to the frame;

an electrostatic charging means mounted to said swingable arm for applying an electrostatic charge to at least one of the entirety of a cut end portion of the web-like material extending across the entire width thereof and the core around which the web-like material is moved;

a cutter for cutting the web-like material across the entire width thereof to produce the cut end portion thereof, said cutter movable to a standby position adjacent one side of the web-like material, and means connected to said cutter and said frame for swinging said cutter relative to said frame to said standby position;

a pair of press members connected to the frame and movable to a cutting position, and means connected to said press members and said frame for supporting the press members on the opposite side of the web-like material from said cutter and for swinging said press members relative to said frame to said cutting position when the cutter is at said standby position, said cutting position being a position at which one of said press members extends adjacent a front side of the cutter and the other of said press members extends adjacent a rear side of the cutter to urge the web-like material across said cutter.

3. An automatic cutting and winding apparatus as claimed in claim 2, and further comprising an air blow nozzle disposed adjacent said electrostatic charging means for blowing air against the cut end portion of the web-like material.

4. An automatic cutting and winding apparatus as claimed in claim 1 or claim 2, wherein said cutter has a plurality of contiguous cutting edges each of which has semi-circular shape, and further comprising a heater for heating the cutter.

5. In a turret type automatic cutting and winding apparatus for automatically cutting continuous web-like material and for winding the web-like material onto a core rotatably supported on a turret, the improvement comprising:

a frame;

a swingable arm connected to the frame;

an electrostatic charging means mounted to said swingable arm for applying an electrostatic charge to at least one of the entirety of a cut end portion of the web-like material extending across the entire width thereof and the core around which the web-like material is moved;

a cutter for cutting the web-like material across the entire width thereof to produce the cut end portion thereof, said cutter movable to a standby position adjacent one side of the web-like material, and means connected to said cutter and said frame for swinging said cutter relative to said frame to said standby position;

a pair of press members connected to the frame and movable to a cutting position, and means connected to said press members and said frame for supporting the press members on the opposite side of the web-like material from said cutter and for swinging said press members relative to said frame to said cutting position when the cutter is at said standby position, said cutting position being a position at which one of said press members extends adjacent a front side of the cutter and the other of said press members extends adjacent a rear side of the cutter to urge the web-like material across said cutter; and swing acceleration means operatively connected to said press members for accelerating the press members toward said cutting position as the press members are swung by said means connected to said press members.

6. An automatic cutting and winding apparatus as claimed in claim 5, wherein said swing acceleration means comprises a spring extending between said swingable arm and said means connected to said press members, and press cylinders for moving said means connected to said press members relative to said swingable arm.

7. In a turret type automatic cutting and winding apparatus for automatically cutting continuous web-like material and for winding the web-like material onto a core rotatably supported on a turret, the improvement comprising:

a frame;

a swingable arm connected to the frame;

an electrostatic charging means mounted to said swingable arm for applying an electrostatic charge to at least one of the entirety of a cut end portion of the web-like material extending across the entire width thereof and the core around which the web-like material is moved;

a cutter movable to a cutting position for cutting the web-like material across the entire width thereof to produce the cut end portion thereof, and means connected to said cutter and said frame for swinging said cutter relative to said frame to said cutting position; and a pair of support members connected to the frame and movable to a standby position adjacent one side of the web-like material, and means connected to said support members for supporting the support members on an opposite side of the web-like material from said cutter and for swinging said support members relative to said frame to said standby position, said cutting position being a position at which said cutter extends between said pair of support members when the support members are at said standby position.

8. An automatic cutting and winding apparatus as claimed in claim 7, wherein said electrostatic charging means includes an electrostatic charging device disposed on at least one of a support portion adjacent said cutter and a support portion adjacent said support members.

9. An automatic cutting and winding apparatus as claimed in claim 7, wherein said means connected to said cutter and said frame for swinging said cutter to said cutting position comprises means for moving a cutting edge of said cutter along a locus that intercepts a point located on the outer surface of the core.

10. In a turret type automatic cutting and winding apparatus for automatically cutting continuous web-like material and for winding the web-like material onto a core rotatably supported on a turret, comprising:

a frame;

a swingable arm connected to the frame;

an electrostatic charging means mounted to said swingable arm for applying an electrostatic charge to at least one of the entirety of a cut end portion of the web-like material extending across the entire width thereof and the core around which the web-like material is moved;

a cutter movable to a cutting position at which the cutter cuts said web-like material across the entire width thereof to produce the portion, and means connected to said cutter and said frame for swinging said cutter to said cutting position;

a pair of press members connected to the frame and movable to the cutting position at which the press members press against the web-like material, and means connected to said press members for supporting the press members on an opposite side of the web-like material from said cutter and for swinging said press members relative to said frame to said cutting position; and an expander roll means disposed adjacent a mill roll consisting of the portion of the web-like material wound around the core and over which the web-like material passes before being wound around the core, said expander roll means for removing creases extending longitudinally in the web-like material before the web-like material is wound around the core.

11. An automatic cutting and winding apparatus as claimed in claim 10, wherein said expander roll means comprises a pair of stationary cams spaced apart from one another in a longitudinal direction extending generally across the web-like material, said cams extending in respective planes that intersect and are inclined relative to said longitudinal direction, and each of said cams having an annular groove extending therein, a pair of rotary members each of which is slidably mounted to a respective one of said cams in the annular groove thereof so as to be rotatable in the annular grooves relative to said cams, and a plurality of rubber bands extending in the longitudinal direction between and mounted to said rotary members, said rubber bands successively contacting the web-like material and rotating with the rotary members as the rotary members rotate relative to the inclined cams so as to expand in the longitudinal direction while contacting the web-like material thereby removing any of the creases extending longitudinally in the web-like material.

* * * * *